US008245825B2

(12) United States Patent
Yoneno et al.

(10) Patent No.: US 8,245,825 B2
(45) Date of Patent: Aug. 21, 2012

(54) SYSTEM FOR CINCHING A RESILIENT LUGGAGE CASE

(75) Inventors: Kenzo Yoneno, Wan Chai (HK); Luc Huyghe, Oudenaarde (BE); Dirk Santy, Koekelare (BE); William L. King, Mansfield, MA (US)

(73) Assignee: Samsonite IP Holdings S.ar.l., Luxembourg (LU)

( * ) Notice: Subject to any disclaimer, the term of this patent is extended or adjusted under 35 U.S.C. 154(b) by 14 days.

(21) Appl. No.: 12/526,261

(22) PCT Filed: Feb. 7, 2008

(86) PCT No.: PCT/US2008/053301

§ 371 (c)(1),
(2), (4) Date: Nov. 29, 2010

(87) PCT Pub. No.: WO2008/098116

PCT Pub. Date: Aug. 14, 2008

(65) Prior Publication Data

US 2011/0174583 A1 Jul. 21, 2011

Related U.S. Application Data

(60) Provisional application No. 60/900,154, filed on Feb. 7, 2007.

(51) Int. Cl.
*A45C 7/00* (2006.01)

(52) U.S. Cl. ..... 190/103; 190/108; 190/115; 190/124; 190/127; 383/33; 220/92

(58) Field of Classification Search ..... 190/103–105, 190/108, 115, 124, 137; 383/33; 220/9.2
See application file for complete search history.

(56) References Cited

U.S. PATENT DOCUMENTS

| | | | | | |
|---|---|---|---|---|---|
| 1,468,711 | A | | 9/1923 | Dwyer | |
| 2,373,573 | A | | 4/1945 | Langford | |
| 2,768,719 | A | * | 10/1956 | Morris et al. | 190/107 |
| 2,798,579 | A | * | 7/1957 | Fox | 190/122 |
| 2,960,137 | A | | 11/1960 | Lipsitz | |
| 3,014,516 | A | * | 12/1961 | Mueller | 220/9.2 |
| 4,141,399 | A | * | 2/1979 | Zoland | 206/554 |
| 4,895,230 | A | | 1/1990 | King | |
| 4,981,215 | A | * | 1/1991 | Ilic | 206/521 |
| 5,031,734 | A | | 7/1991 | King | |
| 5,205,610 | A | * | 4/1993 | Reninger | 297/380 |
| 5,350,241 | A | * | 9/1994 | Zoland | 383/127 |
| 5,890,571 | A | | 4/1999 | Sadow | |
| 5,913,448 | A | | 6/1999 | Mann | |
| 5,927,450 | A | | 7/1999 | Sadow | |
| 6,024,265 | A | * | 2/2000 | Clements | 224/630 |
| 6,105,214 | A | | 8/2000 | Press | |
| 6,443,274 | B1 | * | 9/2002 | Klamm | 190/18 A |
| 7,328,779 | B2 | | 2/2008 | King | |
| 7,699,149 | B2 | * | 4/2010 | Lin et al. | 190/103 |
| 2002/0178766 | A1 | | 12/2002 | Jackson | |
| 2003/0106895 | A1 | * | 6/2003 | Kalal | 220/9.2 |
| 2006/0037553 | A1 | | 2/2006 | Miller | |
| 2009/0236195 | A1 | * | 9/2009 | Lupkas | 190/103 |
| 2010/0282555 | A1 | * | 11/2010 | Tseng et al. | 190/103 |

* cited by examiner

*Primary Examiner* — Tri Mai
(74) *Attorney, Agent, or Firm* — Dorsey & Whitney LLP

(57) ABSTRACT

A remote cinching device 14 comprising a resiliency mechanism 15 and 16, a force-transferring device 17, and a cinching device 28, 30, 32 enhances luggage, totes, briefs, and other transport and/or storage devices. The resiliency mechanism biases the luggage in an open condition, while the cinching device, located remotely from the areas undergoing the highest levels of expansion force (the top and bottom ends of an upright luggage case, for example), allows effective, easy, and visually pleasing compression of the case once it has been closed. The cinch is carried by force-transferring structures 17, by which the act of cinching is made even more efficient.

29 Claims, 13 Drawing Sheets

SYSTEM FOR CINCHING A RESILIENT LUGGAGE CASE

CROSS-REFERENCE TO RELATED APPLICATIONS

This application is the national stage application of PCT Patent Application No. PCT/US2008/053301 filed on Feb. 7, 2008 and entitled "System For Cinching a Resilient Luggage Case", which claims the benefit under 35 U.S.C. §119(e) to U.S. Provisional Patent Application No. 60/900,154 filed on Feb. 7, 2007 and entitled "System For Cinching a Resilient Luggage Case".

TECHNICAL FIELD

The present embodiment provides a method and system that allows for varied packing volumes within a luggage case by providing a normally expanded luggage case that can be easily and stylishly compressed using a unique remote cinching device. More specifically, the present embodiment relates to a luggage case having resilient frame portions that bias the case in an expanded position and are compressed by the cinching device remotely located from these frame portions so that when activated (cinched), the cinching device provides an opposing force to those expanding forces imposed on the luggage case by the frame portions.

BACKGROUND

Luggage cases of typical construction include soft-side, hard-side, semi-rigid, hybrid structure (a combination of both soft-side and hard-side portions). There have been many systems suggested to make the packing volume of such luggage cases easily adapt to the needs of the traveler. An article of luggage that provides expansion and compression capabilities is disclosed in U.S. Patent Publication No. 2005/0194227 by William King and Ethan Mitchell of Samsonite Corporation, entitled, "Expansion System for a Luggage Case", herein incorporated by reference.

There still exists a need, however, for a luggage case that provides varying amounts of compression—such a system may employ a system of straps, for example, that functions by a great amount of user input and emits a functional, very stylish aura. It would be beneficial to have a cinching system, one in which a webbing strap could be used to provide easy compression of the bag for storage or to firmly hold the travelers contents by maintaining the degree of cinch (compression) on the bag, all without using an unsightly expansion gusset.

It would be a design and functional advantage to provide a method of opposing an expansion force that is disposed remotely from the location of the expansion force. This positioning would make the case easier to compress, especially when manual methods are used, and would be visually appealing. In luggage, straight lines are considered to be less visually appealing than curved lines. Providing a case that may comprise both a front and back, somewhat curved panels would be a selling point.

There is therefore a need for a conformable luggage case, briefcase, tote, purse, carryon, or other travel bag that remains lightweight, easy to compress (requires little force), and stylish. A benefit of such as case would be to provide the user with an easy to carry and stow conformable luggage case that could be compressed after being closed, and/or during travel depending upon the location in which it will be stowed (such as under an airplane seat or in an overhead compartment). A further benefit would be to provide easy access to at least a portion of the case without having to release the compression or remove the case from its stowed location.

SUMMARY

Accordingly, the disclosed embodiments include a luggage case having a front panel, a rear panel, a flexible rail extending around at least one corner portion of the case and extending between the front panel and the rear panel, and a resilient frame device in said rail for providing a restoring force to push the front and rear panel away from one another whereby the luggage case tends to remain in an expanded condition. A portion of the resilient frame device is located in the corner portion of said case, and the resilient frame device is capable of repeated flexural strain such that at least portions thereof can be brought together repeatedly, whereby the frame device provides a restoring force to the rail when it is flexed by a cinching device. This cinching device is located remotely from the corner portions, said cinching device is carried by a force transferring structure affixed to the front panel and rear panel. This force transferring structure facilitates cinching action of the cinching device, wherein said cinching action exerts a force in the direction opposite the direction of the restoring force.

Preferably the force transmitting structure comprises triangular shaped tabs that are extensions of the fabric of the front and rear panels of the case, and the resilient frame device includes frame portions mounted at the corners of the front and rear panels, and "V" shaped portions extending along the sides of the case the depth of the rail.

DETAILED DESCRIPTION OF THE PRESENT EMBODIMENT

Figure 1:
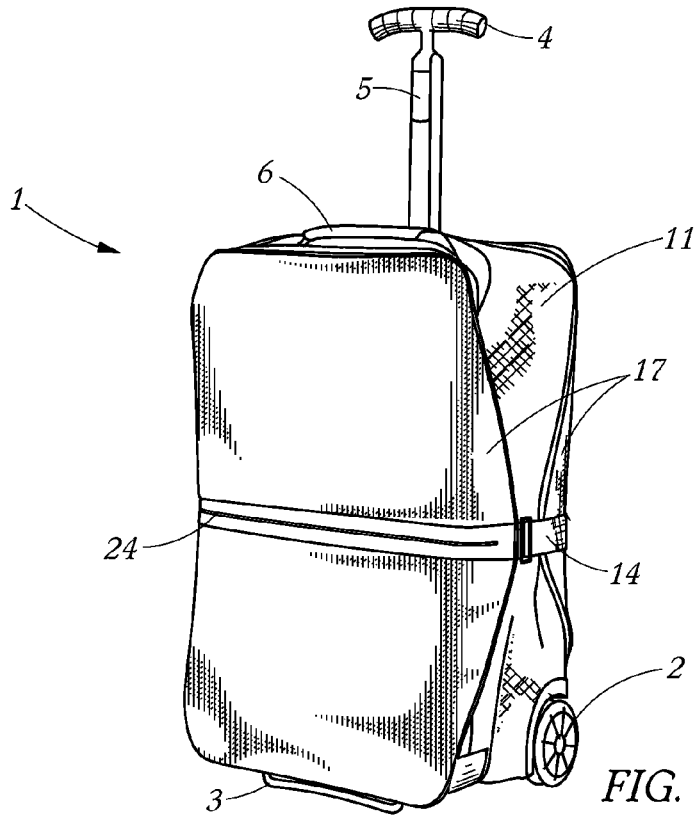
FIG. 1 shows a front perspective view of an upright luggage case having an expansion/compression system comprising an internal resiliency device and a force-transferring structure, and an external cinching device that is carried by the force transferring structure.

The present embodiment accomplishes these goals by providing a remote cinching system and method that stylishly creates compression and automatic expansion of a luggage case while also supplying an infinite number of intermediate, secure positions between a fully compressed position and a fully expanded position. The remote cinching system works in combination with resilient portions, which may comprise resilient "frame" portions, to expand the case without the use of a zipper or zippered gusset, and to perform compression of the case once the case has been packed, closed, and locked. A functional and attractive design feature, a force-transferring structure, lends a unique look to the case and carries the cinching mechanism, so that the act of cinching the case to a degree of compression desired by the user (traveler) is facilitated.

The term "luggage" herein is meant to include all types of storage and/or transport cases such as briefcases, computer bags, messenger bags, backpacks, purses, lunch bags, duffel bags, garment bags, wheeled duffel or garment bags, and other totes.

FIGS. 1 through 22 show an upright luggage case 1 having standard wheels 2 and a bumper 3 onto which the case rests when standing erect. Except as will be detailed, the upright case may generally comprise standard construction and structure according to what is typically known in the art, including a tow handle 4, main packing compartment 8, which may include various packing structures such as fixed or removable packing aids including suiters and the like, pockets, lining, and so on, and carrying handle 6. The main packing compartment is accessed through a peripheral zipper 9 that adjoins the side panels of the main packing compartment to a lid 13, that may include on its interior surface pouches or panels accessed by zipper 22. The luggage case of FIGS. 1 through 23 incorporates the remote cinching system 14, comprising internally mounted resilient members 15 and 16, externally mounted force-transferring structures 17, and a remote cinch 28 through 33. Although it can be contemplated that the remote cinching mechanism, force-transferring structure, and resilient device may be incorporated into hard-body or hybrid luggage designs, the present embodiment comprises soft-side luggage case materials. As such, the panels of the upright luggage case may comprise a body portion of nylon, vinyl, polyester, tweed, or tapestry fabric (usually a polyester and cotton blend with acrylic), or similar flexible laminate material. The material of the front and back panels 21 and 25, as well as the force-transferring structures 17 carried thereby, may comprise protective, durable, 400 denier nylon twist and 300 denier polyester dobby weave. The side panels or rail 11 of the main body of the case may comprise 420 Denier Nylon which has a slightly more "neutral" look in comparison. A benefit of using the rugged material, for example, is that the material, which exhibits a textured pattern having raised, matte, herringbone vertical lines disposed on a somewhat reflective background, lends an air of stylish and unique professionalism to the case.

Typically constructed soft-side luggage includes conventional steel frames and reinforced corners as well as floor panels. In contrast, the present embodiment has a sleek, lightweight, simple yet effective expansion system, carried out by the resilient frame members 15, 16 etc., that effectively replaces traditional luggage frames, which resilient frame members are activated by a remote cinching mechanism mounted to the case as will be detailed.

In the past, luggage frames have also been constructed of wood or magnesium. More recently, luggage frames have been made of glass-filled nylon, as can be seen in Samsonite luggage pieces, steel, aluminum, spring steel, spring wire, or plastic (most commonly Polyvinyl chloride or PVC, especially, rigid, suspension-type PVC). Honeycomb PVC frames contain extruded air pockets within the frame, allowing the frame to flex when force is applied to the frame.

Usually, soft-sided suitcases include metal frames that are made up of a ribbon of thin corrugated sheet steel approximately 1-3" wide running around the interior of the case. Four plastic inserts that surround the entire frame often support the corners of these metal frames. Most steel frames are generally quite rigid and not resiliently constructed to hold the case open.

The resilient frame device of the present invention comprises a narrow resilient wire frame member that acts as a spring biasing the case in the open position. While any shape, dimension, type, or composition of the resilient member could be contemplated, preferably each resilient member comprises a spring steel wire, having hollow or solid construction with a circular cross-section. The circular cross-section has inherent strength and serves to facilitate equal force distribution along the length of the frame.

Any material that would provide structure to the case and possess resilient properties could be used. For example, the resilient frame could comprise polyurethane elastomer, certain types of rubber, or any other resilient material.

Figure 8:
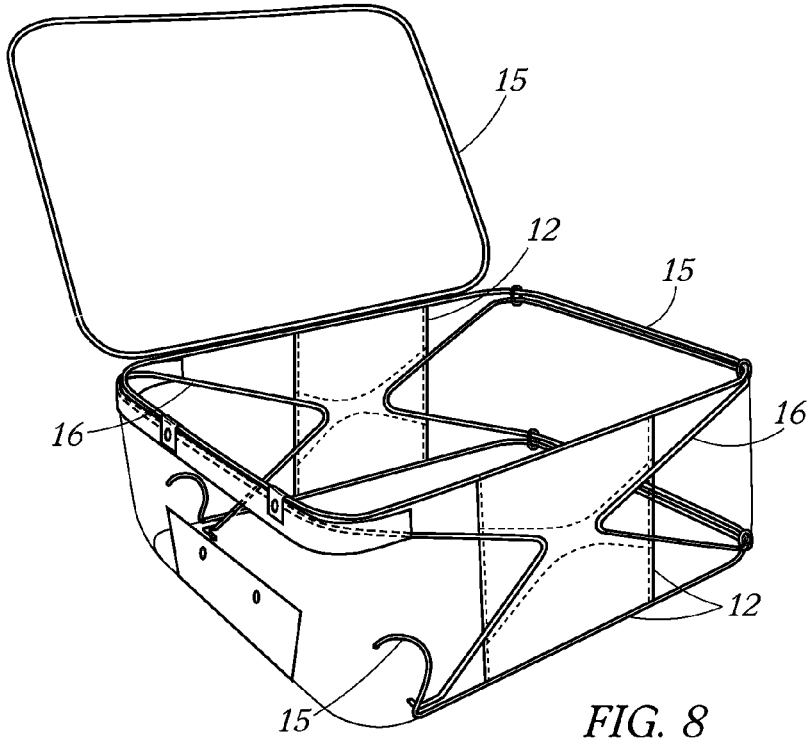
FIG. 8 is a partially transparent view of the case of FIG. 7 showing the resilient frame within the body of the case.
Figure 9:
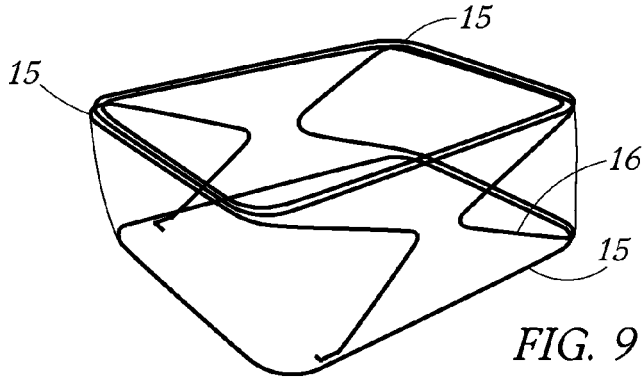
FIG. 9 is an illustration of the resilient frame of FIG. 8 in an uncompressed state.
Figure 10:
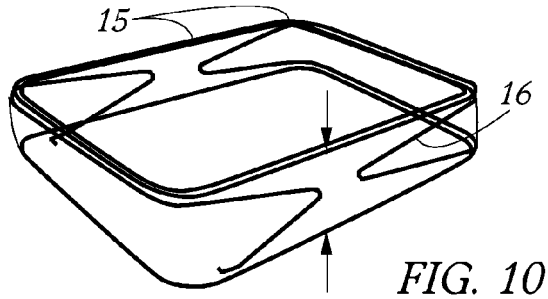
FIG. 10 is an illustration of the resilient frame of FIG. 8 in a compressed state.

As can be seen in FIGS. 8, 9, and 10, two independent wire frames 15 are symmetrically positioned opposite one another, one along the top of the case, and one along the bottom of the case. The wire frame occupying the top portion of the case is a continuous wire, traversing the periphery of the top half of the case, and is bent into a single "V" shape or undulation 16 near the mid-portion of the case along each of the case's side panels. The resilient frame occupying the bottom portion of the case traverses the front edge of the bottom panel of the case, having a "V" shape near the mid portion of the case that nearly converges with the V-portion of the upper resilient frame, and terminates in the back panel of the case. The convergence of the two pairs of V-portions of each wire preferably occurs in the mid-portion, so that the remote cinching device, also located at the mid-portion, can be more easily operated. The present embodiment incorporates resilient portions that have substantially continuous segments near the corners of the front and back panels 21 and 25, which provide a "full look" to the case even when empty. This helps the purchaser better visualize how the case will look when fully packed during travel. As will be detailed, these resilient frame members also provide a resilient restoring force to help hold the case fully open and erect during packing It should be understood by one of ordinary skill in the art that the resilient portions need not be long, nor continuous, but may in fact comprise shorter and/or more numerous portions.

The frame portions could inhabit other portions of the case. To not intrude on the packing space in the main packing compartment the resilient frame members are attached to the rail portion 11 by stitching to a fabric panel 12 with a thin flexible foam sheet 10 (FIG. 12) between panel 12 and the interior lining. The rail portion typically comprises a relatively narrow textile construction defining the depth dimension between the front and back panels of the bag. The frame members' springy portions 16 traverse the depth dimension of the rail. While shown having a single undulation with an overall "V" shape, these portions could have any shape, form, or length, whether built directly into the rail as shown or made as an aftermarket accessory. The frame system could be attached to the inside surface of the rail portion, using any means of attachment, including hook and loop fasteners, snaps, straps, and so on. Conversely, the resilient members may be located within the corner portions of the case, or any other location, and comprise any length, shape, or cross-section. The resilient members need not be of continuous construction. For example, a gusseted bag might incorporate resilient portions in its corners. Such as system could benefit hybrid luggage cases, diaper bags, purses, storage vessels such as molded plastic boxes having an upper expandable portion, and so on. Furthermore, the shape (type of undulations), number of undulations, or tightness of radius could vary depending upon the desired function of the case.

The resilient frame is capable of repeated flexural strain such that at least portions of the frame can be brought together repeatedly, yet still maintain a restoring force to the luggage panels they inhabit when the panels are flexed towards one another by a cinching device. The cinching action exerts a force in the direction generally opposite the direction of the restoring force.

Referring to the figures, the cinching device is located remotely from the corner portions of the case and hence away from the location of highest resilient expansion or restoring force. In the present embodiment, a pair of straps 28 each extending across the depth of the rail 11, attach to and visually traverse the font and back panels of the bag respectively. These can be tightened, or cinched, to achieve compression of the luggage case once the case has been closed. The direction of force applied by the cinching device lays in a plane that is perpendicular to the plane of the height dimension of the front and back exterior panels. As such, when the cinching device is cinched, the distal longitudinal ends of the case tend to slightly "flare" outwardly, as the mid-portion of the case is contracted, creating an aesthetically pleasing "hour-glass" shape to the profile of even the partially cinched or compressed case. Also, since packed items tend to push out mostly on the center portion of a packed case, locating the cinching device across this center portion and locating the resilient frame members at or near the corners helps preserve a tailored, stylish appearance even when the case 1 is somewhat overpacked.

Figure 2:
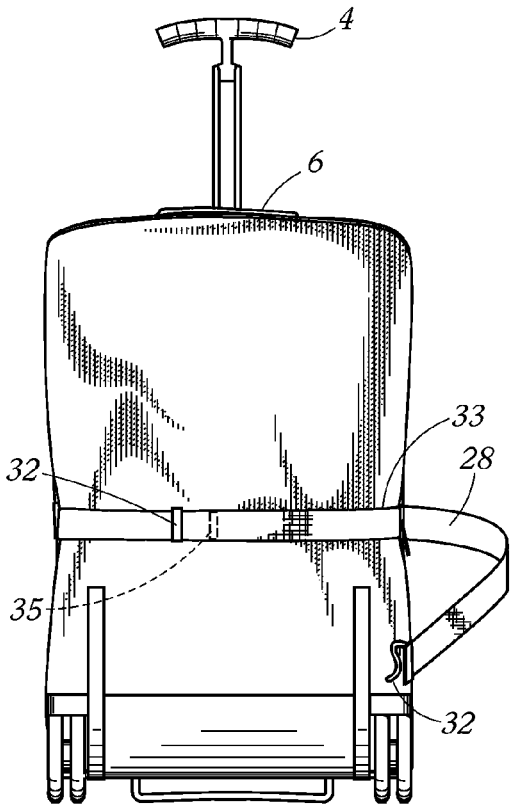
FIG. 2 shows a back view of the luggage case of FIG. 1 showing stitched loops that act as securing points for the cinching strap fastening clips.
Figure 16:
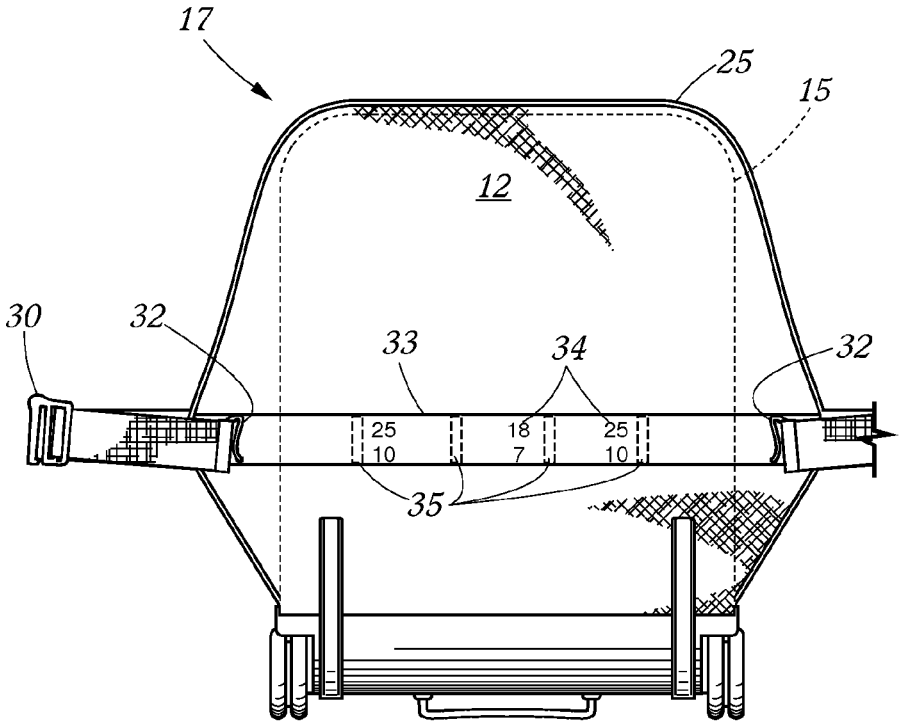
FIG. 16 is a back view of the case of FIG. 1 showing the exterior surface of the back panel having two force-transferring structures and a cinching strap disposed on and extending from the free ends of each force-transferring structure.

Preferably, the cinching mechanism is mounted to the outside of the case, onto an external panel. The strap may include clips or simple hooks 32 that engage the stitched loops 35 once the bag has been compressed, as shown in FIGS. 2 and 16. Referring to the figures, the back strap 33 has embroidered markings 34 that act as indicators of the degree of compression of the case. For example, the embroidered markings may comprise numeric measurements (in metric and empirical) that correspond to the case's depth thereby showing, to the user and airline personnel, the depth of the bag when the hook 32 is held in the stitched loop 35 adjacent to that numeric designation. This indicia is very handy and relevant during air travel when specific size requirements of the case (especially carry-on sized bags) must be met.

Other securing mechanisms could be employed to hold the position of the strap (and thus restrain and indicate the degree of the cinch). Such securing mechanisms may comprise snaps, hook and loop fastener tabs, and so on. One could envision a barbed end of the strap that may bite into strap 33 or another part of the case, hook and loop fasteners that run along the entire length of the strap 33, along its edge or other portion, or many other methods.

An advantage of using a cinch in place of other compression methods currently known in the art, which may include expansion gussets/zippers and the like, is that one may somewhat forego precisely estimating the packing volume needed prior to packing and simply pack as desired, then simply compress the case to embrace the packed items after the case has been packed and closed. The cinching device applies even pressure around the bag, creating a relatively uniform compressive force against the outward spring bias of the resilient frame members and the packed items in the main packing compartment. Of course, the cinching device could comprise other forms or embodiments. For example, one could envision a combination of straps, a bungee system, use of other fabric panels, or other methods.

The compressive force provided by the cinched straps is carried to the front and back panels by a force-transferring mechanism. In the present embodiment, the force-transferring mechanism comprises a triangular shaped outcropping, or extension 18, of the front and rear exterior fabric panels of the case. This front panel comprises the lid 13. Of course, it should be noted that the force-transferring mechanism could be located on any portion of the case. For example, the extension could exist on the lower portion of the case, as is disclosed in FIG. 23. The extension could accommodate a cinching strap that might diagonally or curvedly traverse the body of the case so long as such shapes also provide a visual recognition tool and a design feature. It should be further noted that the force-transferring mechanism could embody any shape, size, or form as well. For example, the force-transferring structure may comprise simple straps that protrude from a panel of the case. In the present embodiment, the outcropping is in the shape of a triangular element, also known as a "tab".

Figure 14:
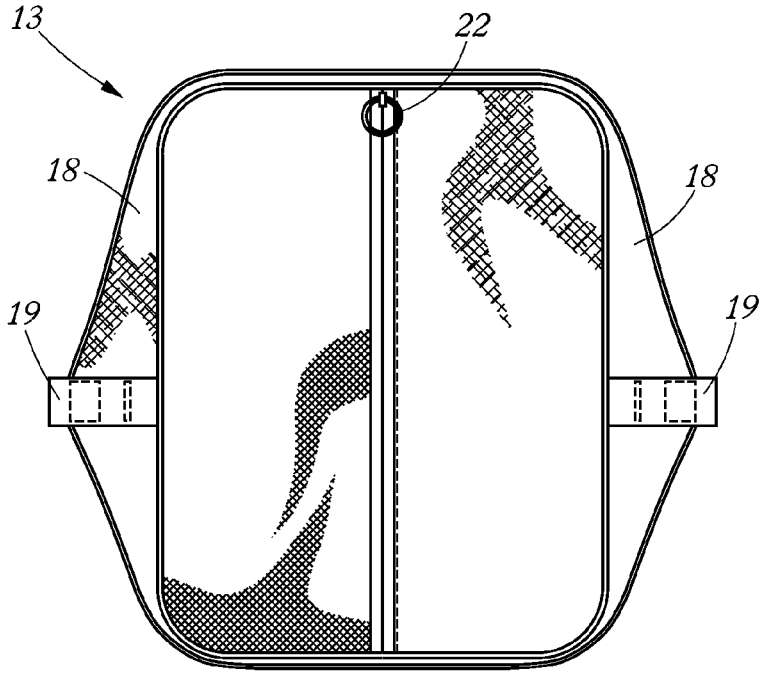
FIG. 14 is a front view of the front panel's interior surface of the case shown in FIG. 1, having a mesh, bloused pocket mounted thereon.
Figure 15:
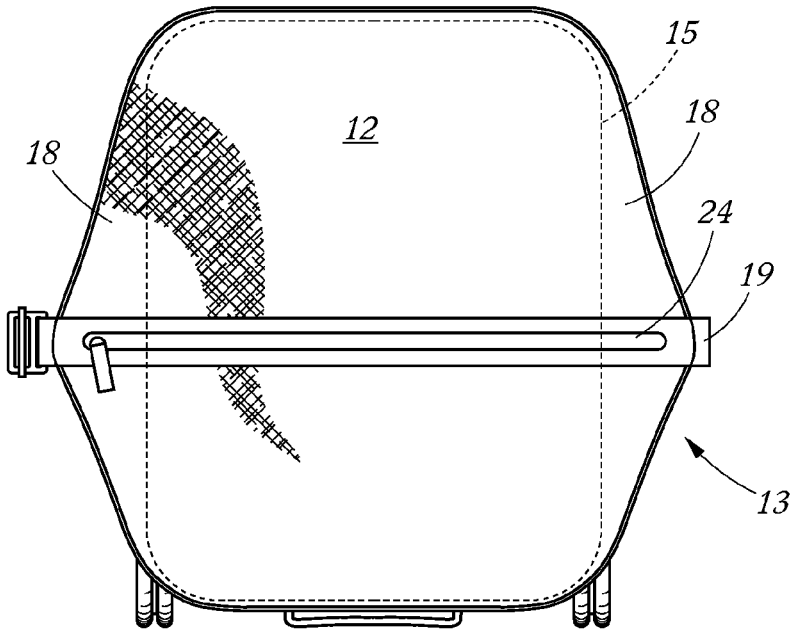
FIG. 15 is a front view of the front panel's exterior surface of the case of FIG. 1 showing a zipper that has been heat-bonded to the exterior surface of the panel and the force-transferring structures.

Thus, the present embodiment's front panel presents a roughly hexagonal shape when laid flat (see FIG. 14). The outcropping, or tab, comprises a broad, shallow triangle that extends outwardly from each opposing longitudinal edge of the front exterior panel of the case. The front panel of the case also carries a heat-bonded zipper 24, as can be seen in FIG. 15 for example. The heat-bonded zipper is mounted by heat bonding methods to the exterior front panel, and provides weatherproofing benefits to the pouch accessed thereby. The zipper is "hidden", having its teeth completely secluded from view. The front exterior of the case thus provides a full-sized pocket for handy retrieval of essential items through this zipper without having to release the cinching strap.

Figure 3:
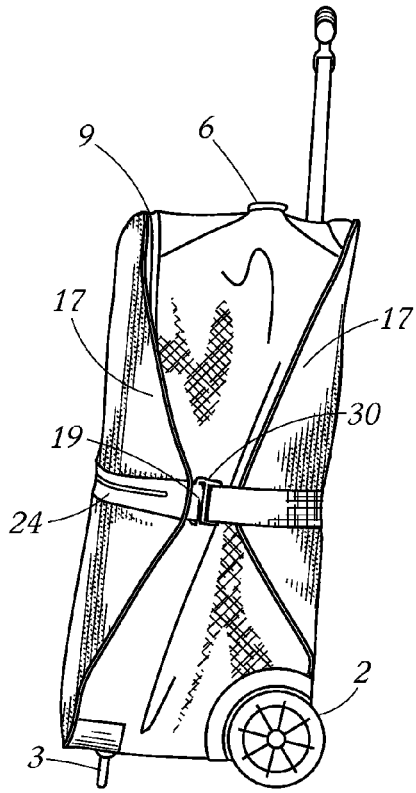
FIG. 3 shows a right side view of the luggage case of FIG. 1 in an expanded condition.
Figure 4:
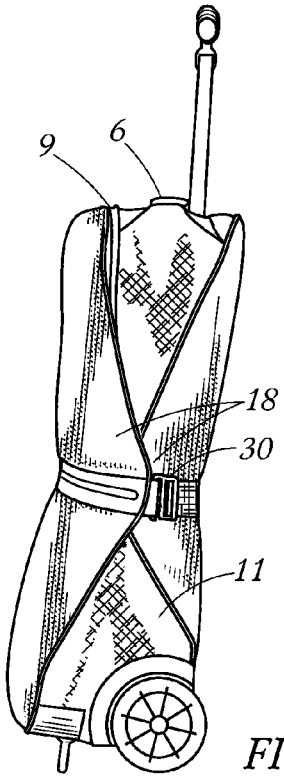
FIG. 4 is a right side view of the luggage case of FIG. 3 when it has been cinched to a fully compressed condition.
Figure 5:
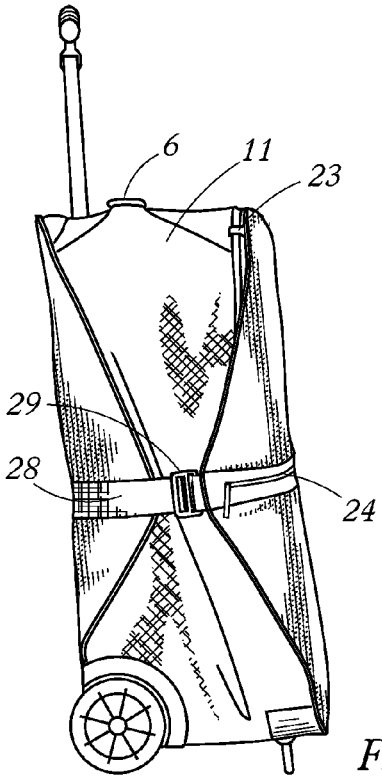
FIG. 5 is a left side view of the luggage case of FIG. 1.
Figure 6:
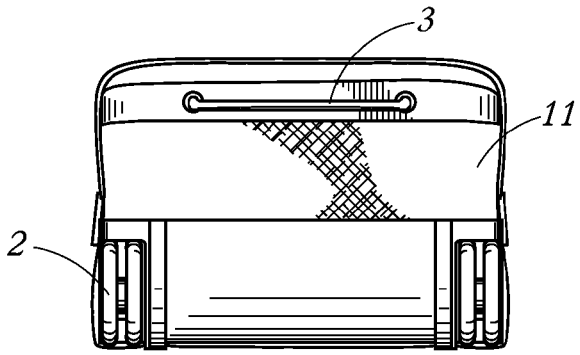
FIG. 6 is a bottom view of the luggage case of FIG. 1 showing a combination glide (or bumper) and handle onto which the luggage case rests when standing erect.
Figure 7:
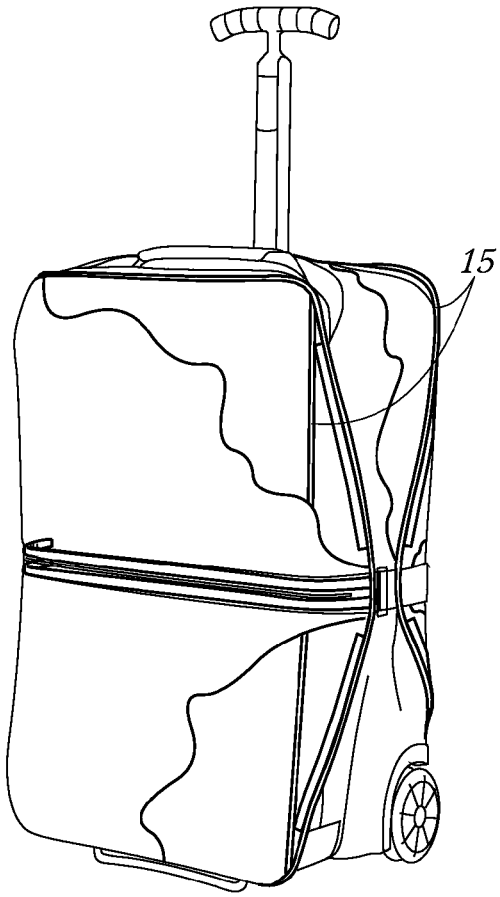
FIG. 7 shows the luggage case of FIG. 1 with portions of the luggage case's fabric covering broken away to reveal resilient frame portions along the edge seams and central portion of the front panel of the case.

Likewise, the back exterior panel 12 of the case also comprises a roughly hexagonal shape formed from the rectangular shape of the overall case when the two tabs 18 are spread out flat. Referring to FIGS. 1 2, and 3, the back exterior panel's dimensions and material match those of the front exterior panel. Of course, these dimensions, including the location of the tab on the back exterior panel, could vary from those dimensions of the front panel tab. In the present embodiment, the back panel further includes a strap 33, of the same height as that of the heat bonded zipper 24 carried by the front exterior panel so as to accommodate the cinching mechanism in a level configuration. It should be noted by one of ordinary skill in the art that the height of the tabs and/or the cinching device straps need not align. Again, it might prove visually pleasing and helpful to unite the front and back panels' respective cinching straps on a diagonal, for example where the cinching device could help support the front portion of the case on the wheels. Of course, the back strap may comprise any width, shape, or material. In the present embodiment, the back strap is of nylon construction. The back strap includes the securing mechanisms 35 that hold the front strap securely in place. Although many types of securing mechanisms could be envisioned, the present embodiment as already suggested employs stitched loops to receive and hold the hook 32 on the terminal end of the strap. Other securing mechanisms such as continuous stitching, (open-ended on the top only), snaps, hook and loop fasteners, and so on could be used depending upon the desired function and look of the case.

Figure 17:
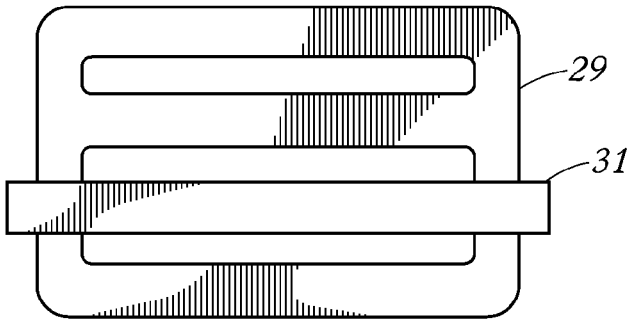
FIG. 17 is a close-up view of a tether ring on the left side of the case
Figure 18:
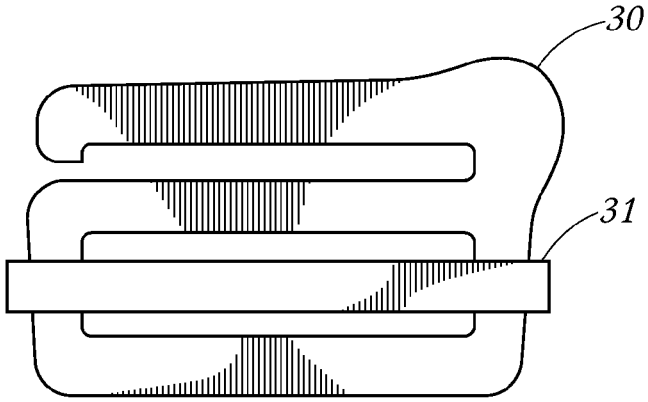
FIG. 18 is a close-up view of a tether hook normally positioned on the tether strap as seen in FIGS. 1 and 3.
Figure 19:
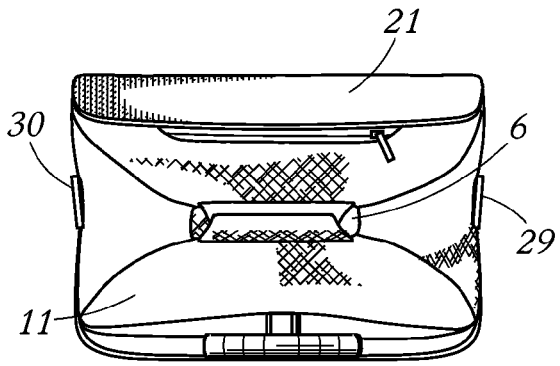
FIG. 19 is a top view of the case of FIG. 1 showing a unique carry handle that retracts into itself or extends to form a tow handle or shoulder strap.
Figure 20:
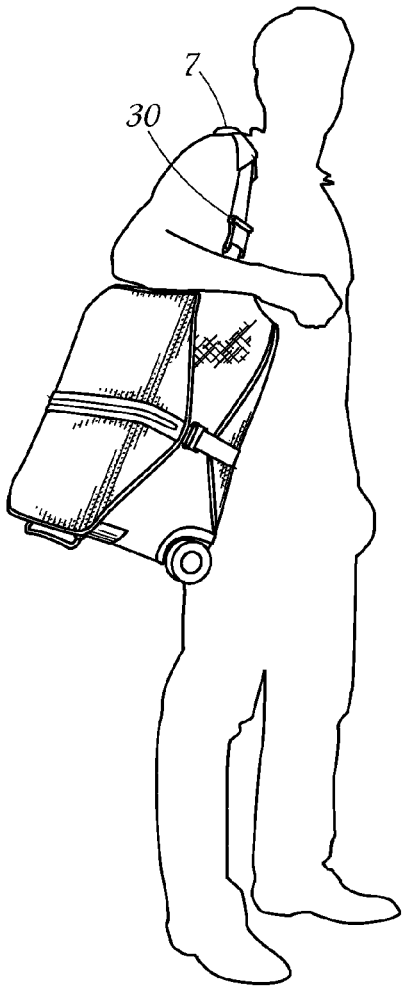
FIG. 20 is an illustration showing one use of the carry handle shown in FIG. 19 as a shoulder strap.
Figure 21:
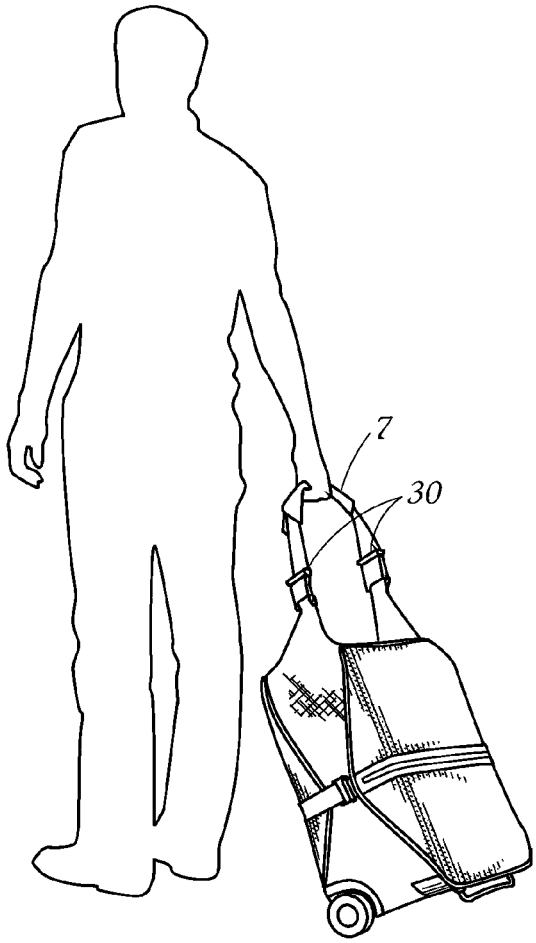
FIG. 21 is an illustration showing another novel and unique use of the multi-functional carry handle of FIG. 19 as a tow handle.

FIGS. 17 and 18 show in detail the securing mechanisms for the cinching strap. A tether ring 29, that is of closed construction, comprises the tensioning buckle mechanism or slider 31 on one end of the strap on the side of the case having a self hinging portion 23 for the main compartment zippered opening 9. An open-ended (releasable) tether clip or hook 30 with a similar buckle or slider 31 lies on the other end of the strap, in this case on the side of the main compartment zipper opening. As is conventional with such buckle systems, the respective straps are threaded through the clip or ring and around the respective sliders so that they hold the tension when the distal ends of the respective straps are pulled. Of course, any securing mechanism could be used, including two tether loops, snaps or buttons, hook and loop fasteners, and so on. This hook permits tensioning of the straps, yet can be slipped out of a receiving loop 19 on the front tab.

The tabs 18 act as a visual focal point and, by virtue of carrying the cinching straps, when the cinching straps are tightened help spread the compression forces. The tabs enhance the visually pleasing hourglass shape that the case takes on when cinched. The cinch, in combination with the force-transferring structure, provides easy application of compressive force against the resilient frames. An additional benefit of the tabs is that, when engaged, they provide protection to the case's peripheral zipper and therefore the contents contained therein. Again, although the force-transferring structure could take any form (including for example, a system of straps, a portion of paneling that may protrude from the front and/or back panels along all or any portion of the panel's edges and may comprise any shape or material, a bungee cord, and so on), a benefit of providing a triangularly-shaped panel, that aesthetically comes out of the front and back panels from their corner portions in a gradual manner, is that the user or traveler becomes immediately aware, based on the unique look of the case, of the functionality of those very same features.

Figure 11:
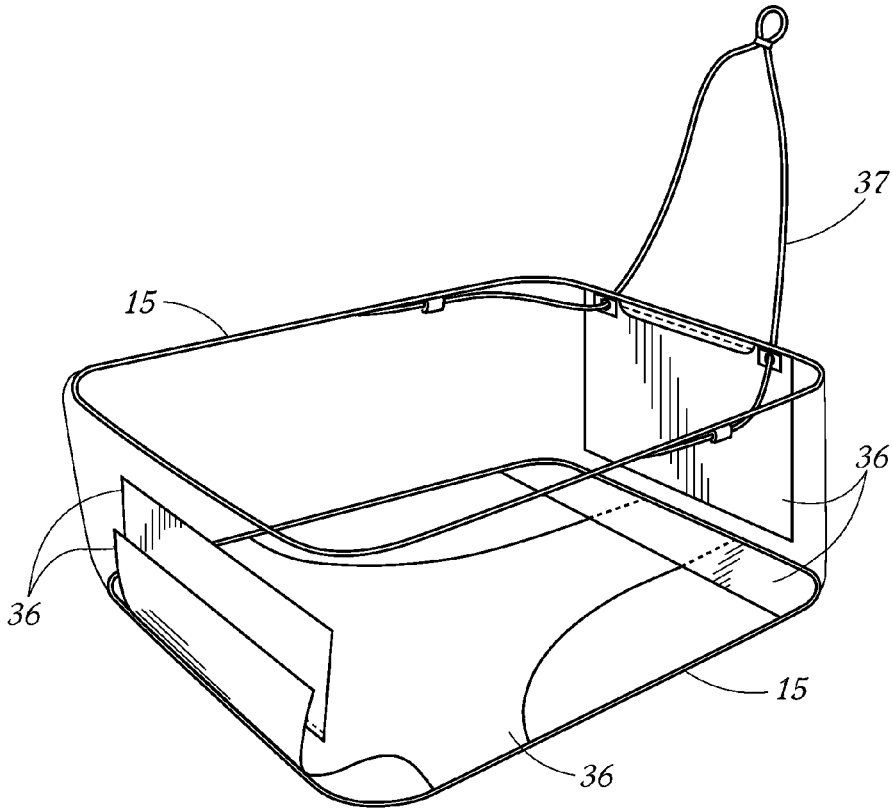
FIG. 11 is a partially transparent view of the case of FIG. 8 revealing the polypropylene sheets and the perimeter wires that gives body and structure to the case. Also shown is a bungee cord for tying to the case a separate tote that may be carried by the case.
Figure 12:
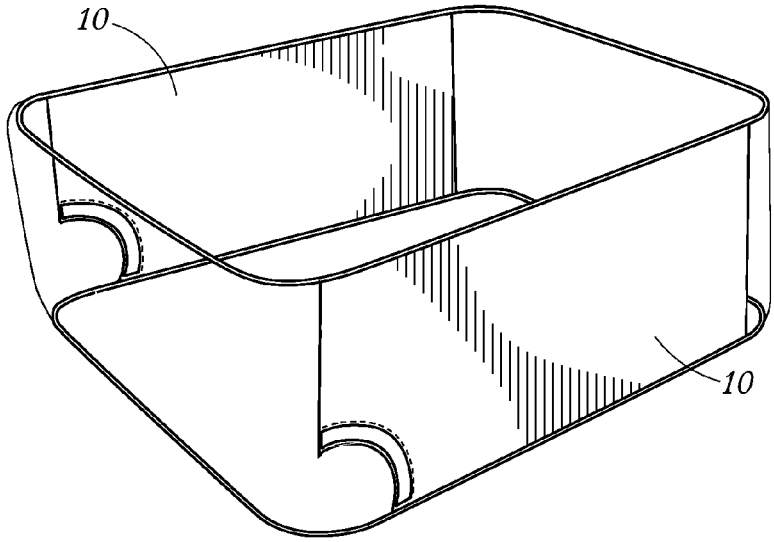
FIG. 12 is a partially transparent view of the case of FIG. 8 revealing soft foam sheets 10.
Figure 13:
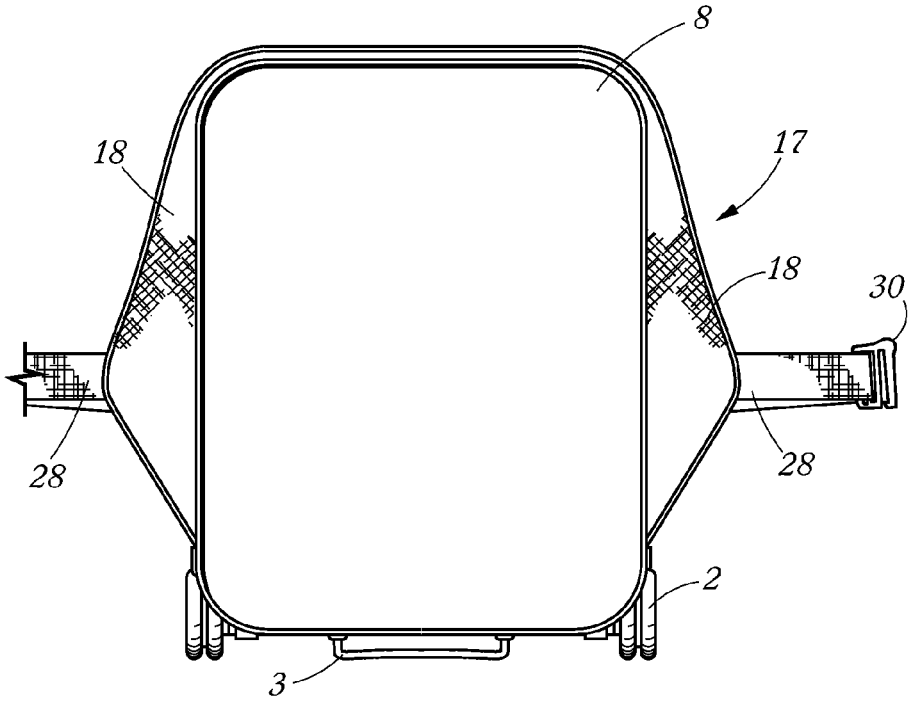
FIG. 13 is a front elevation view of the interior of the case of FIG. 1, showing the interior surface of the back panel of FIG. 2. The back panel has two force-transferring structures, one each disposed on a right and left opposing side of the panel, and a cinching strap disposed on and extending from the free ends of each force-transferring structure on the exterior surface of the back panel.

The interior of the case may comprise a variety of support and/or structural mechanisms. The present embodiment incorporates various sheets 36 of polypropylene along the panels of the interior surface. Referring to FIG. 11, the back panel of the case has a polypropylene sheet having strategically-place cutouts, lending a curved look to the sheet. The polypropylene sheet provides structure to the case, as well as protection of the retractable rigid-handled tow handle 4. The cutouts, while acting as an effective weight-reducer (without compromising the structural benefit of the sheet), may also allow further compression of the case while still providing significant structure and protection of goods enclosed therein. The sheet may be attached to the case by sewing, gluing, or other methods. The case could comprise, on at least portions of its interior and/or exterior surfaces, any type of supporting structure of varying shapes and compositions. For example, sheets of vinyl, polypropylene, or other material could encompass the entire back portion of the case. It could conversely be contemplated that there not be any sheet at all, lending the case to an entirely soft-bodied structure. Also shown in FIG. 11 is a bungee cord 37 for attaching to the case a separate tote that may be carried by the case.

The handle 6 of the present embodiment surpasses traditional handle paradigms by providing a retractable/extensible handle that can be extended far enough so as to act as a tow handle. The handle of the present embodiment comprises flexible material construction and can fold in on itself within a bale wrap or grip 7. An advantage of a soft tow handle is that its strap design (two anchor points from which a strap unfolds) allows for easy directing/swerving. It is a time-saver to be able to carry a luggage case over one's shoulder and set the case down to tow it by the same handle without making adjustment. With a minor adjustment of either folding the strap within the bail wrapper using a ring or clip 30 similar to those used on the cinching device, or simply shortening the tether of the strap, the strap becomes a short, "hand strap" or carry handle. Thus it becomes economical to provide the traveler with an alternative towing mechanism to the rigid tow handle.

Figure 22:
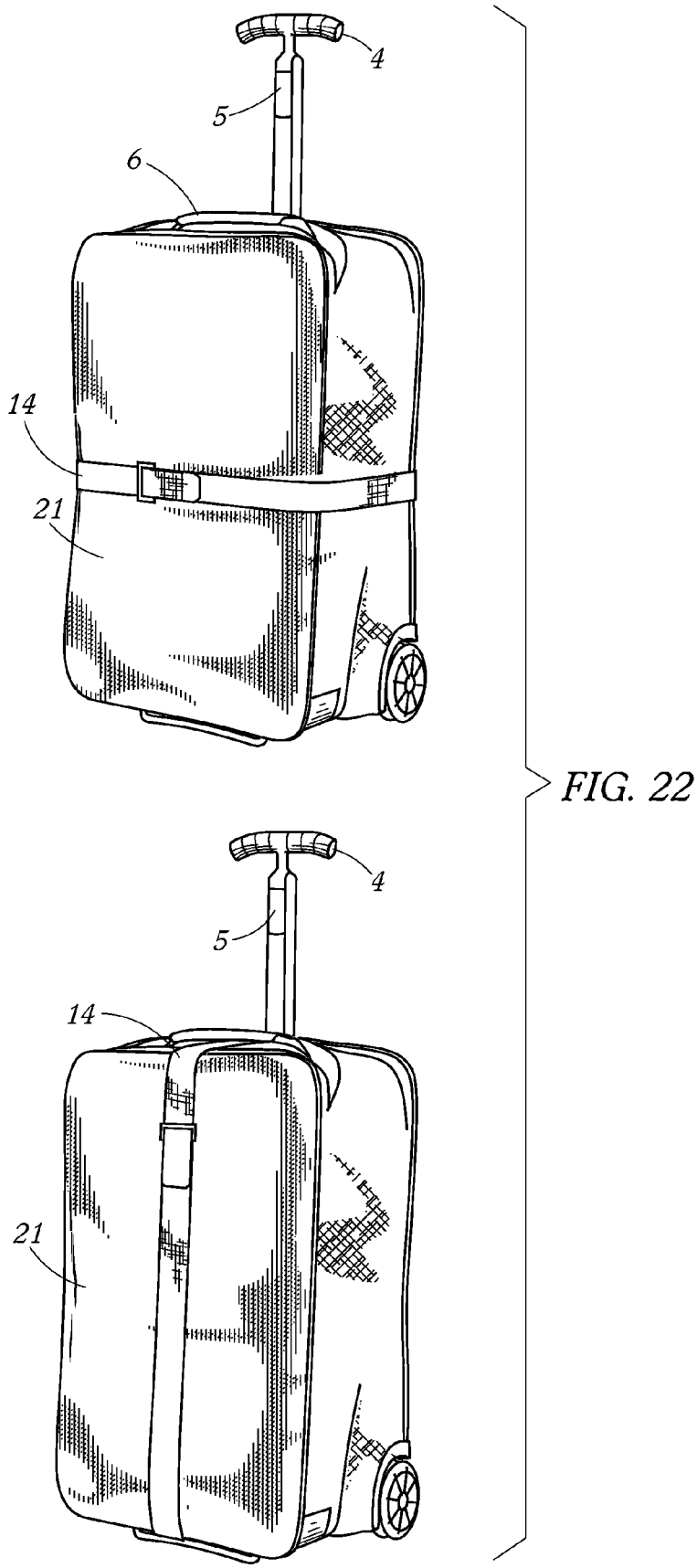
FIG. 22 shows two alternative embodiments: a luggage article having a horizontally-encircling cinching strap and a vertically-encircling cinching strap respectively.

Referring to FIG. 22, two alternative embodiments illustrate how a luggage case can incorporate the remote cinching device and a stiffer but still resilient frame device without the external tab-type force-transferring structure. As illustrated with regard to the description of the upright luggage case embodiment, the novel placement of the cinch in relation to the resilient mechanism can create a unique, hourglass shape when the cinch is activated. Examples of such a case are the luggage case with a cinching strap that encircles the case's exterior along its height, or vertical, axis, and a case having a cinching strap encircling the case along its width, or horizontal axis. The beauty of the case is evident and the user appreciates the functionality.

Figure 23:
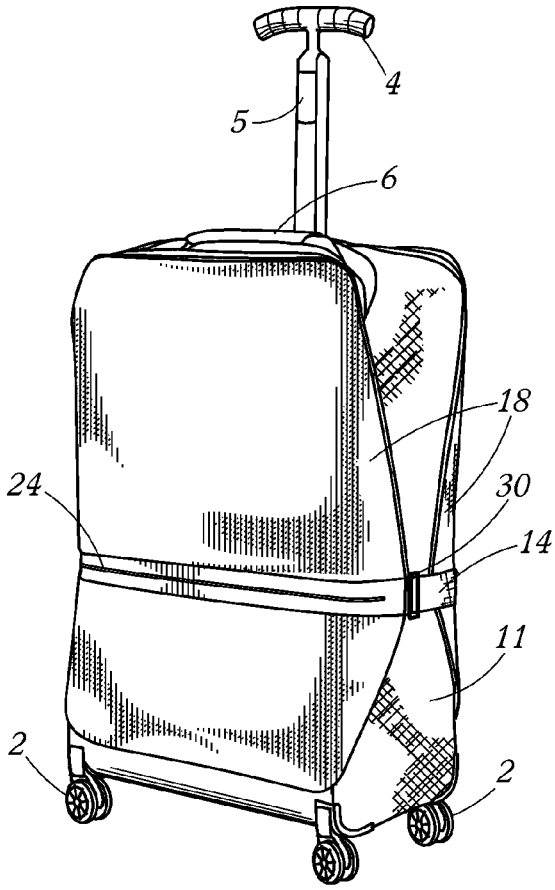
FIG. 23 is an alternative embodiment wherein a spinner-type wheeled upright luggage case carries a cinching strap and force transferring structure wherein the cinching strap and terminal portions of the force-transferring structure lie on a lower half of the body of the case.

FIG. 23 shows a spinner-type wheeled luggage case having the resilient (frame) device, force-transferring structure 18, and remote cinching device 14 located along a lower quadrant of the case. Aesthetically, the case is slightly different, while functionally, the cinching device again provides ease of compression and expansion of the case.

Figure 24:
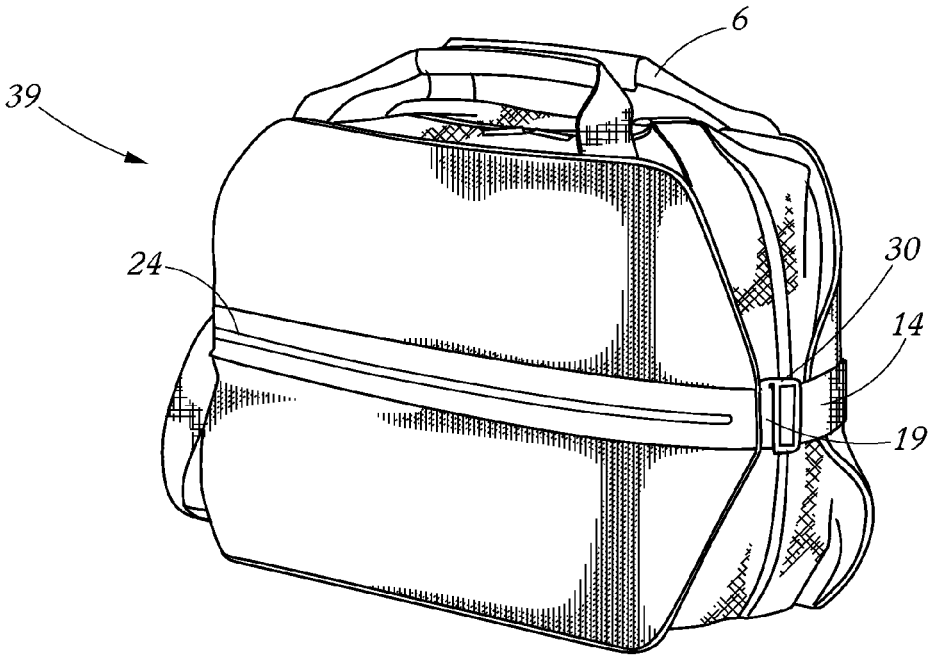
FIG. 24 is a perspective view of an alternative embodiment wherein a business case comprises the resilient frame and remote cinching device carried by the fabric force-transferring structure.
Figure 25:
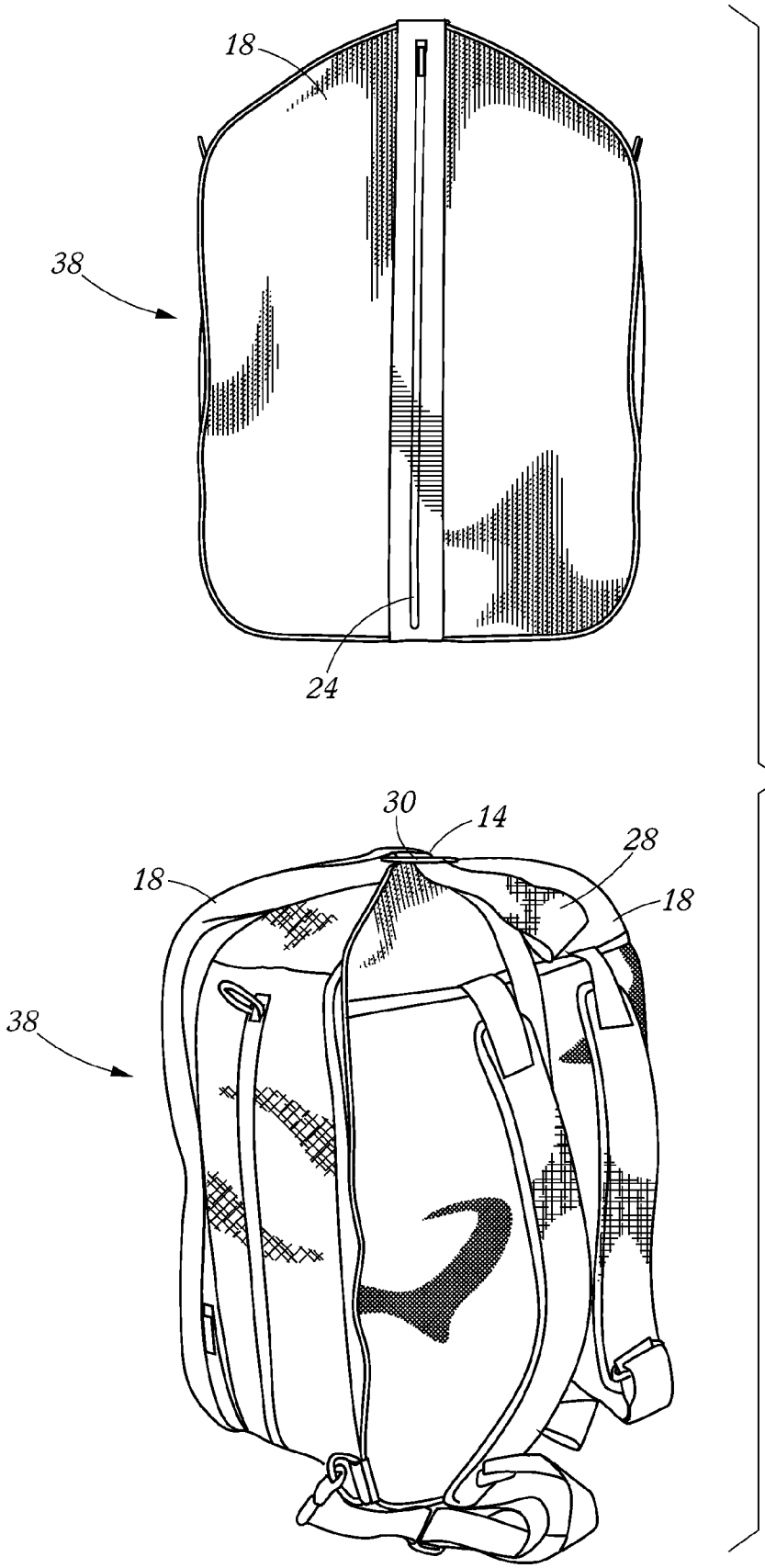
FIG. 25 shows front plan view and back perspective view of a backpack version of the present embodiment having a remote cinching device carried by the fabric force-transferring structure.
Figure 26:
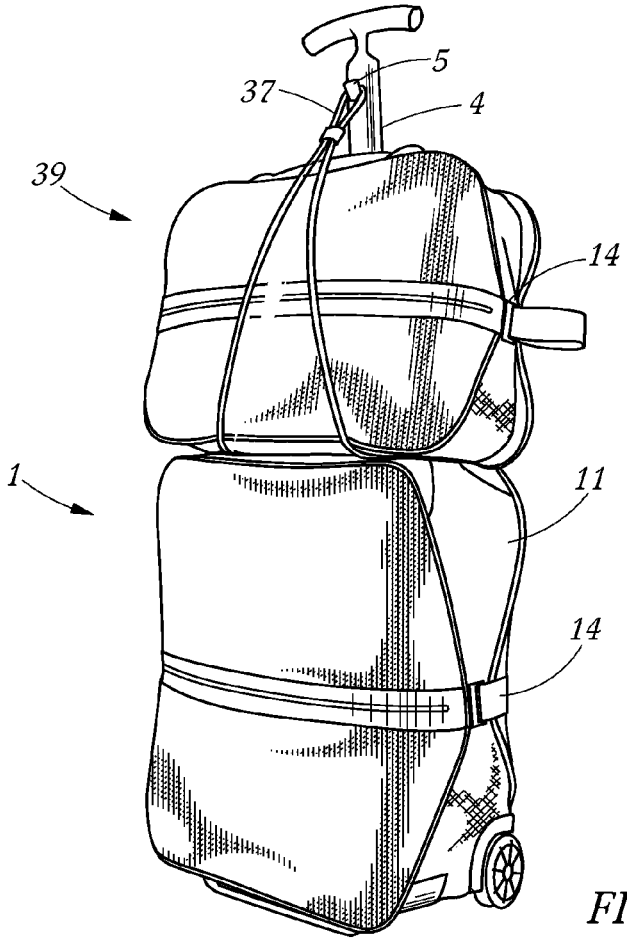
FIG. 26 is a front perspective view of a combination system of the upright luggage case shown in FIG. 1 and the business case of FIG. 24 utilizing a bungee system of FIG. 11 for support.
Figure 27:
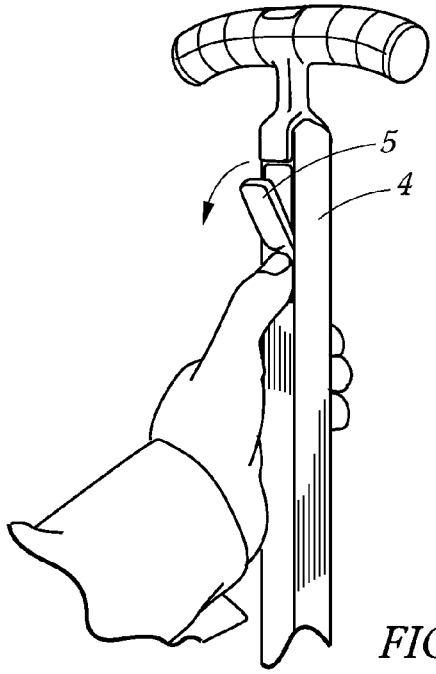
FIG. 27 is a close-up view of the handle of FIGS. 1 and 26 showing a flip-out hook for items such as jackets, purse straps, bag handles, and the bungee cord of FIG. 26.

FIGS. 24 through 26 show alternative embodiments of the remote cinching system. Referring to FIG. 24, a business case 39 can be remotely and stylishly cinched by a pair of straps 14, each on a front and pack external panel of the business case, wherein the straps are carried by force-transferring structures, specifically tabs.

A unique employment of the remote cinching system 14, 28, and 30 can be seen in FIG. 25. A backpack 38 having two force-transferring tabs 18, one on each a back panel and a front panel of the backpack, can be compressed over its top portion simply by employing a cinching mechanism carried by the tabs. It should be noted by one of ordinary skill in the art that of course, the backpack may or may not include an internal resiliency device such as a resilient frame to create automatic expansion of the packing compartment of the backpack.

FIG. 26 shows a unit of luggage comprising a wheeled upright luggage case, 1 as that of FIG. 1, carrying an additional case 39. The wheeled upright case includes a bungee cord system, as previously discussed with regard to the description of FIG. 11. The bungee 37 may be mounted at an interior location of the case and is slidable to the exterior through discreet apertures to be engaged with an engagement mechanism or the bungee cord could remain significantly external, having an internal pocket into which it can be folded and stored.

The tow handle of the upright case of FIG. 1 could include a multi-purpose hook 5. The hook may normally be embedded within the body of the tow handle 4, and could be hinged at its lower end so as to flip outwardly upon the push of a portion of the hook itself. The hook can hold the bungee cord, or directly support coats, clothing hangers bags, straps of purses and totes, and so on. When the bungee cord is used to secure bags to the handle, the system can accommodate bags of varying sizes. This is because a significant length of cord can be stored in the interior of the case as discussed with regard to FIG. 11 for example.

Benefits of providing a tote/storage structure with the remote cinching device include automatic expansion and compression of the vessel once it has been closed. A benefit of incorporating a resilient member into the composition of the case is that when adjusting the cinching strap, the case can be squeezed, providing slack to the strap and ease of removal of the hook from the stitched loops. The remote cinching mechanism can be applied to any structure, including purses, doctor's bags, totes, systems incorporating a rigid structure, and so on. For example, any case that is expandable, perhaps by a system of accordion-type panels facilitated by hinge pins and/or the like could enjoy the benefits of the resilient portions, force-transferring structure, and cinch. A rigid vessel that includes a soft-side portion (expandable gusset or so on) could also enjoy the benefits of the remote cinching system.

Although the present embodiment has been described with a certain degree of particularity, it is understood that the present disclosure has been made by way of example, and changes in detail or structure may be made without departing from the spirit of the invention as defined in the appended claims.

The invention claimed is:

1. A luggage case having a front panel, a rear panel, a flexible rail extending around at least one corner portion of the case and extending at least part of the distance between the front panel and the rear panel, a resilient frame device in said rail, with portions of said frame device located in a corner portion of said case for providing a restoring force to push the front and rear panels away from one another whereby the luggage case tends to remain in an expanded condition, whereby the resilient frame device is capable of repeated flexural strain such that at least portions thereof can be brought together repeatedly, whereby said frame device provides a restoring force to said rail when said rail is flexed by a cinching device, said cinching device is located remotely from the corner portions, said cinching device is carried by a force transferring structure affixed to said at least one of said front panel and rear panel, that facilitates cinching action of the cinching device, wherein said cinching action exerts a force in the direction opposite the direction of the restoring force, the force transferring structure includes a panel extension that extends from the cinching device to the corner portion, and wherein the panel extension is a triangularly-shaped portion of flexible fabric, the base of the triangularly-shaped portion of fabric is attached to and extends along a side of said at least one panel, and the cinching device applies a force generally perpendicular to the base of the triangularly-shaped portion.

2. The luggage case of claim 1 wherein the resilient frame device is a steel wire.

3. The luggage case of claim 1, wherein at least one of the front panel or the rear panel comprises a flexible laminate material.

4. The luggage case of claim 1, wherein the resilient frame device comprises two independent wire frames.

5. The luggage case of claim 4, wherein the two independent wire frames are symmetrically positioned opposite one another with one of the two independent wire frames occupying a top portion of the luggage and the other of the two independent wire frames occupying a bottom portion of the luggage.

6. The luggage case of claim 5, wherein the independent wire frame occupying the top portion of the luggage case comprises a continuous wire that traverses a periphery of a top half of the luggage case and is bent into an undulation near a mid portion of the luggage case along each of the luggage case's side panels.

7. The luggage case of claim 6, wherein the independent wire frame occupying the bottom portion of the luggage case comprises a wire with an undulation that nearly converges with the undulation of the independent wire frame occupying the top portion of the luggage case.

8. The luggage case of claim 1, further comprising a flexible sheet of foam that is positioned between the resilient frame device and an interior lining of the luggage case.

9. The luggage case of claim 1, wherein the cinching device comprises a pair of straps, each strap extending across a depth of the rail.

10. The luggage case of claim 9, wherein one of the straps is attached to and traverses the front panel, and the other strap is attached to and traverses the rear panel.

11. The luggage case of claim 9, wherein the cinching device further comprises a clip that is joined to one of the straps and is configured to engage stitched loops defined by one of the straps.

12. The luggage case of claim 1, wherein the cinching action of the cinching device is actuated by cinching the cinching device, and when the cinching device is cinched, distal longitudinal ends of the luggage case flare outwardly and a mid-portion of the luggage case contracts to create an hour-glass shape to a profile of the luggage case.

13. The luggage case of claim 1, further comprising a soft tow handle joined to the luggage case.

14. The luggage case of claim 13, wherein the soft tow handle comprises a strap anchored to the luggage case at two points and configured to be selectively folded and unfolded to selectively increase and decrease a length of the strap.

15. A luggage case having a front panel, a rear panel, a flexible rail extending around at least one corner portion of the case and extending at least part of the distance between the front panel and the rear panel, a resilient frame device in said rail, with portions of said frame device located in a corner portion of said case for providing a restoring force to push the front and rear panels away from one another whereby the luggage case tends to remain in an expanded condition, whereby the resilient frame device is capable of repeated flexural strain such that at least portions thereof can be brought together repeatedly, whereby said frame device provides a restoring force to said rail when said rail is flexed by a cinching device, said cinching device is located remotely from the corner portions, said cinching device is carried by a force transferring structure affixed to said at least one of said front panel and rear panel, that facilitates cinching action of the cinching device, wherein said cinching action exerts a force in the direction opposite the direction of the restoring force, and wherein the force transferring structure includes a relatively stiff frame member extending from the cinching device to the corner portion.

16. The luggage case of claim 15 wherein the force transferring structure includes a panel extension that extends from the cinching device to the corner portion.

17. The luggage case of claim 15, wherein the resilient frame device is a steel wire.

18. The luggage case of claim 15, wherein at least one of the front panel or the rear panel comprises a flexible laminate material.

19. The luggage case of claim 15, wherein the resilient frame device comprises two independent wire frames.

20. The luggage case of claim 19, wherein the two independent wire frames are symmetrically positioned opposite one another with one of the two independent wire frames occupying a top portion of the luggage and the other of the two independent wire frames occupying a bottom portion of the luggage.

21. The luggage case of claim 20, wherein the independent wire frame occupying the top portion of the luggage case comprises a continuous wire that traverses a periphery of a top half of the luggage case and is bent into an undulation near a mid portion of the luggage case along each of the luggage case's side panels.

22. The luggage case of claim 21, wherein the independent wire frame occupying the bottom portion of the luggage case comprises a wire with an undulation that nearly converges with the undulation of the independent wire frame occupying the top portion of the luggage case.

23. The luggage case of claim 15, further comprising a flexible sheet of foam that is positioned between the resilient frame device and an interior lining of the luggage case.

24. The luggage case of claim 15, wherein the cinching device comprises a pair of straps, each strap extending across a depth of the rail.

25. The luggage case of claim 24, wherein one of the straps is attached to and traverses the front panel, and the other strap is attached to and traverses the rear panel.

26. The luggage case of claim 24, wherein the cinching device further comprises a clip that is joined to one of the straps and is configured to engage stitched loops defined by one of the straps.

27. The luggage case of claim 15, wherein the cinching action of the cinching device is actuated by cinching the cinching device, and when the cinching device is cinched, distal longitudinal ends of the luggage case flare outwardly and a mid-portion of the luggage case contracts to create an hour-glass shape to a profile of the luggage case.

28. The luggage case of claim 15, further comprising a soft tow handle joined to the luggage case.

29. The luggage case of claim 28, wherein the soft tow handle comprises a strap anchored to the luggage case at two points and configured to be selectively folded and unfolded to selectively increase and decrease a length of the strap.

* * * * *